United States Patent [19]

Diggle, Jr.

[11] 3,973,303

[45] Aug. 10, 1976

[54] COMPACTOR SHOE ADJUSTMENT FOR COMPRESSIVE SHRINKING MACHINES

[75] Inventor: Edmund A. Diggle, Jr., Ho-Ho-Kus, N.J.

[73] Assignee: Compax Corporation, Woodside, N.Y.

[22] Filed: July 30, 1975

[21] Appl. No.: 600,307

[52] U.S. Cl. ..... 26/18.6
[51] Int. Cl.[2] ..... D06C 21/00
[58] Field of Search ..... 26/18.6

[56] References Cited

UNITED STATES PATENTS

| | | | |
|---|---|---|---|
| 2,199,011 | 4/1940 | Schreiner | 26/18.6 |
| 2,765,514 | 10/1956 | Walton | 26/18.6 |
| 2,915,109 | 12/1959 | Walton | 26/18.6 UX |
| 3,015,145 | 1/1962 | Cohn et al. | 26/18.6 |
| 3,015,146 | 1/1962 | Cohn et al. | 26/18.6 |

*Primary Examiner*—Robert R. Mackey
*Attorney, Agent, or Firm*—Mandeville and Schweitzer

[57] ABSTRACT

The disclosure relates to the provision of improved and advantageous facilities for the on-line adjustment of the length of the compressive shrinking zone in a so-called two roll compactor. The compactor shoe is supported at each end, by a pair of primary levers arranged to pivot around the axis of a feeding roll. By movement of the primary levers, the tip of the compacting shoe, forming the upstream end of the compressive shrinking zone, is movable toward or away from a roller nip, formed by opposed feeding and retarding rollers and constituting the downstream end of the compressive shrinking zone. A simple, reliable and precise adjustment feature is provided, enabling the operator to easily and quickly effect precision adjustment of the position of the shoe tip, while the equipment is in full speed operation, so that the processing of materials in the compactor may be optimized. The physical arrangement of the new adjustment feature is such that, in addition to its significant functional advantages, it is readily adaptable to the structure of standard forms of equipment in the field, for on-site upgrading of machine performance.

9 Claims, 10 Drawing Figures

115
163
128
173
129
150
132
126
117
137
133
113
120
127
140
121
SECOND STATION
119
122
123

COMPACTOR SHOE ADJUSTMENT FOR COMPRESSIVE SHRINKING MACHINES

BACKGROUND AND SUMMARY OF THE INVENTION

The present invention is concerned primarily with improvements in the performance of so-called two roll compactors, such as are in widespread commercial use for the compressive shrinkage treatment of tubular knitted fabrics. In this respect, the features of the invention are particularly useful in conjunction with apparatus of the type reflected in the prior Eugene Cohn et al. U.S. Pat. Nos. 3,015,145, 3,015,146 and 3,083,435. The equipment disclosed in these patents is intended primarily, although not necessarily exclusively, for the compressive shrinkage treatment of tubular knitted fabrics, to produce finished fabric and garments having minimum residual shrinkage characteristics. In general, the equipment described in the before mentioned patents includes a pair of rollers arranged in opposed relation and forming a compacting nip. One of the rollers is considered a feeding roller and the other a retarding roller, the latter having a surface speed which is controllably slower than that of the feeding roller. In accordance with principles expressed in the patents, fabric is typically laterally distended and steamed, and then delivered into surface contact with the feeding roller. The fabric is lightly confined against the surface of the feeding roller by means of a curved shoe, so that the fabric is driven in a relatively positive manner toward the roller nip formed by the opposed feeding and retarding rollers.

As the incoming fabric approaches the roller nip, it emerges from under the confining surface formed by the shoe. In accordance with the teachings of the above mentioned patents, the downstream or discharge end of the shoe is formed into a relatively sharp, blade-like edge or tip, which extends across the full width of the shoe and forms a sharp line of demarcation. The tip of this blade-like edge generally is located somewhere around one-quarter inch upstream from the roller nip and defines the upstream end of a compressive shrinking zone. The downstream end is, of course, defined by the roller nip, and opposed sides of the zone are defined by the roller surfaces themselves in the region between the shoe tip and the roller nip.

In general, in the operation of the compressive shrinkage equipment described, fabric is driven in a feeding direction by the feeding roller, until the fabric emerges from underneath the blade-like shoe tip and enters the compressive shrinking zone. In that zone, the fabric is decelerated to a speed determined by the slower surface speed of the retarding roller, whose surface is constituted to have a somewhat greater frictional grip on the fabric than does the feeding roller, in the region of the roller nip. Since the fabric is entering the compression zone at a higher rate of speed than it leaves, the fabric necessarily is compressed lengthwise in the zone. As the longitudinally compressed fabric passes through the roller nip, it is subjected to heat and localized rolling pressure, which stabilizes the fabric in its longitudinally compressed condition.

Among the various machine adjustments that can significantly affect the processing of the fabric in the compressive shrinking operation, an important one is the control of the length of the compressive shrinking zone, as determined by the spacing of the shoe tip from the roller nip. This spacing can be quite critical, and in practice it is adjusted with considerable precision.

Although the fabric processing operation often is highly sensitive to variation in the length of the compressive shrinking zone, adjustment of the zone has in the past been relatively difficult and time consuming with existing equipment, largely because of the need for meeting co-existing requirements of ruggedness and precision. Thus, in most cases, it has been necessary to stop the equipment before making an adjustment, and in any case the adjustment was sufficiently complex and time consuming as to tend to discourage a machine operator from making a minor adjustment, as might otherwise be indicated for greatest process optimization.

The present invention provides a novel, rugged and completely reliable precision adjustment mechanism, for controlling the length of the compressive shrinking zone, which enables the machine operator to adjust the zone with great precision, by means of a hand wheel or similar device located on the control side of the machine. The arrangement is such that the operator can, by a simple one hand manipulation, make precision changes in the compression zone length while the equipment is in operation and the operator is thus able to observe immediately the effect of the adjustment on the fabric emerging from the roller nip. With this arrangement, an experienced machine operator can easily optimize the performance of the equipment, as appropriate to accommodate various types and weights of fabric, different fibers and constructions, and other variables in the process.

In accordance with another feature of the invention, an advantageous form of shoe tip adjustment mechanism is provided which is largely compatible with standard forms of equipment now in the field. Accordingly, much of the existing equipment can be retrofitted with the new adjustment feature, enabling a significant upgrading in the performance of already existing installations of two roll compactor equipment of the type contemplated herein.

For a better understanding of the above and other features and advantages of the invention, reference should be made to the following detailed description and to the accompanying drawings.

DESCRIPTION OF THE DRAWINGS

FIG. 4 is a simplified, cross-sectional representation taken generally on line 4—4 of FIG. 2.

DESCRIPTION OF PREFERRED EMBODIMENTS

Figure 1:
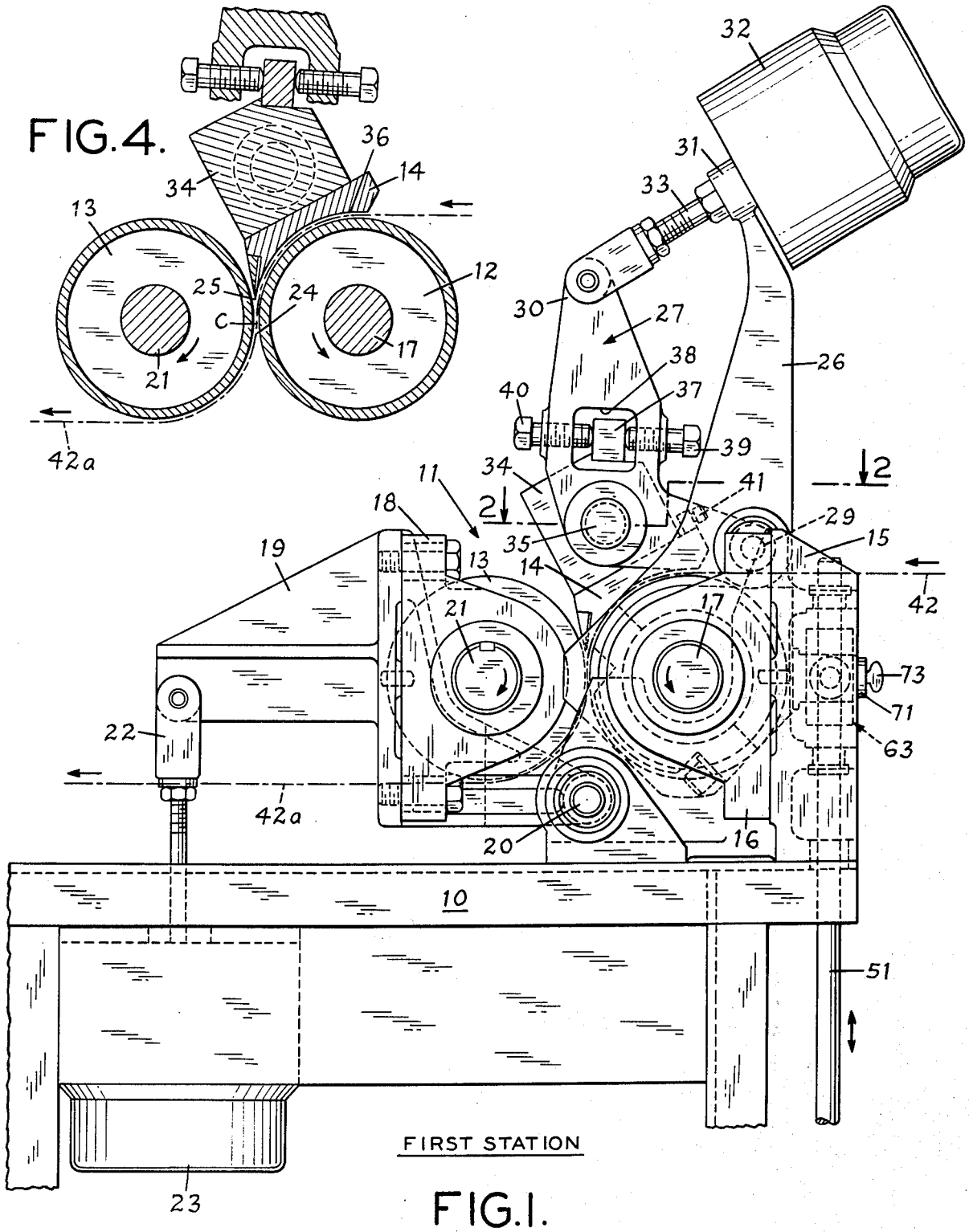
FIG. 1 is a side elevation of a portion of a two-station, two-roll compacting machine, intended particularly for the compressive shrinking of tubular knitted fabrics.

Referring now to the drawings, and initially to FIG. 1, the reference numeral 10 designates in a general way a machine frame structure, on which is supported a compacting station generally designated by the reference 11 and comprising in its most essential components a feeding roller 12, retarding roller 13, and compacting shoe 14. The compacting station 11 may be the primary station of a single stage compactor, as generally illustrated in the before mentioned Eugene Cohn et al. U.S. Pat. No. 3,015,145 or, more typically, it may be the first station of a two station compactor as generally reflected in the Eugene Cohn et al. U.S. Pat. No. 3,015,146.

In the compactor station illustrated particularly in FIGS. 1–4, there is provided an upstanding bracket 15, at each side of the machine frame, to which are secured pillow blocks 16. The pillow blocks 16 journal the shaft portions 17 of the feeding roller, for rotation about a normally fixed axis with respect to the machine frame. Suitable means, not illustrated, are provided for driving the feed roller at one end, at a controllable speed. A second pair of pillow blocks 18 is secured to swing brackets 19, which are pivoted at 20 on the machine frame. The pillow blocks 18 journal the shaft portions 21 of the retarding roller 13 for rotation about an axis parallel to the axis of the feed roller 12.

In the standard commercial form of compactor apparatus presently marketed, the swing brackets 19 are connected at each side of the machine to the operating rods 22 of pneumatic actuators 23 mounted on the machine frame. When these actuators are retracted, the brackets 19 are pivoted downward about their pivot axis 20, swinging the retarding roller 13 downward and away from the feeding roller 12. Appropriate stops, not shown, are provided to limit the upward or clockwise swinging movement of the brackets 19, when the actuators 23 are extended, in order to establish the proper working space between the opposed surfaces of the feeding and retarding rollers, at the compacting nip 24 (FIG. 4).

As reflected particularly in FIG. 4, the compactor shoe 14 typically is provided with a blade-like shoe tip 25, which forms the downstream edge of the shoe. The roller nip 24 and the shoe tip 25 define the downstream and upstream ends respectively of a compressive shrinking zone C, as more fully explained in the before mentioned patents.

Adjustable positioning of the shoe and shoe tip is provided by means of a compound lever arrangement, including primary levers 26 and secondary levers 27, at each side of the machine. The primary levers 26 are journalled on the feed roller shaft 17, for pivoting movement about the axis thereof, and these levers are normally locked in a predetermined rotational orientation by means of positioning lugs 28, as will be hereinafter described in more detail.

Figure 2:
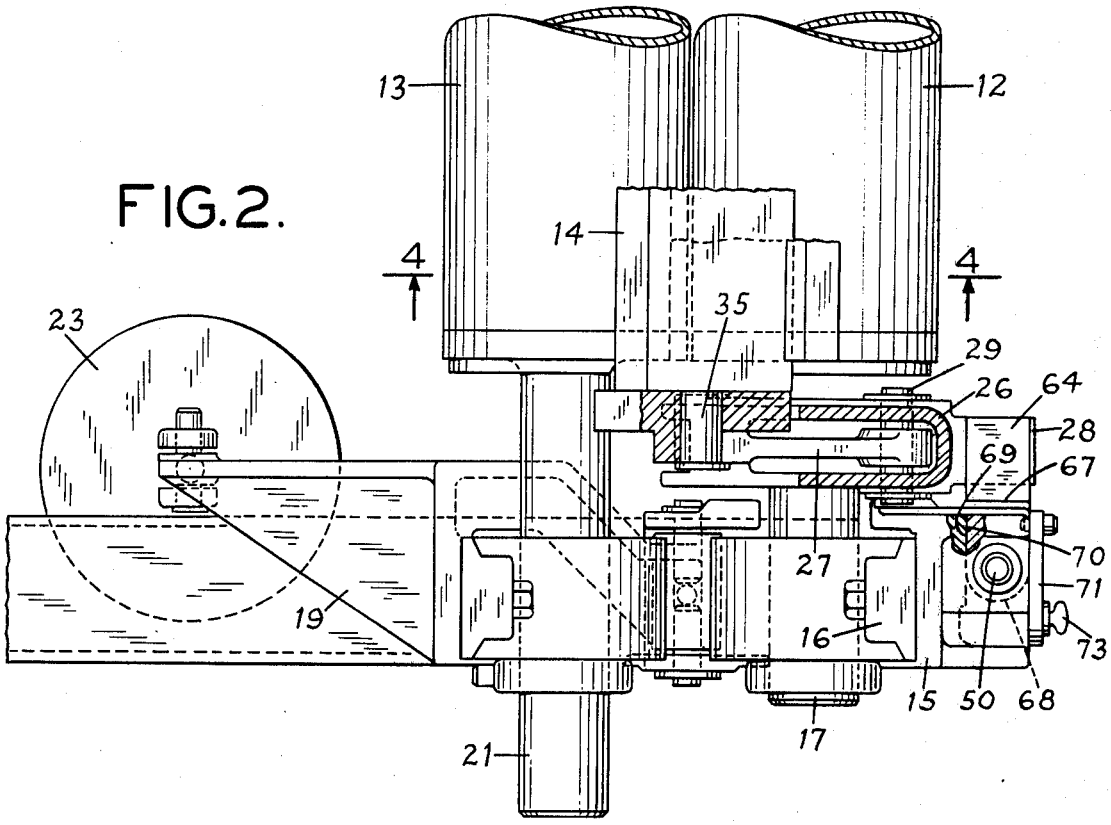
FIG. 2 is a fragmentary sectional view taken generally along line 2—2 of FIG. 1.
Figure 3:
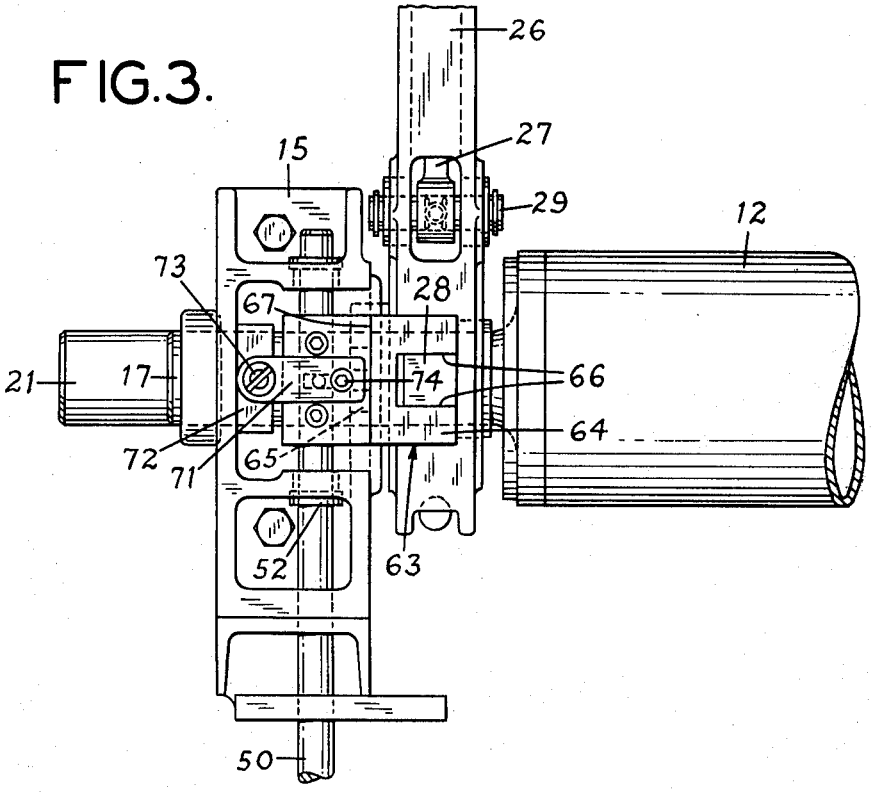
FIG. 3 is an enlarged, fragmentary front elevational view illustrating details of the new adjusted mechanism.

As reflected in FIGS. 1 and 2, the secondary levers 27 are pivoted to the primary levers 26, by means of pivot pins 29. The upper ends 30 of the secondary levers are connected to the upper ends 31 of the primary levers, by means of pneumatic actuators 32. As is apparent in FIG. 1, when the operating rods 33 of the actuators are retracted, the secondary levers 27 are raised and pivoted clockwise, lifting the shoe clear of the feed roller 12. Suitable stop means, not shown, are provided to rigidly limit the extending movement of the operating rods 33, such that the feeding shoe 14 will be returned to a precisely adjusted, pre-established relationship with the primary levers 26, when the actuators 32 are extended. A rigid beam 34 is pivotally secured by stub shafts 35 to the secondary levers 27. This rigid beam in turn carries and rigidly supports the shoe plate 14.

As reflected in FIG. 4, the lower surface 36 of the shoe plate 14 is curved to conform generally to the outer surface of the feed roller 12. Thus, among the adjustments of the shoe, for proper precise positioning with respect to the feed roll, are the rotational orientation of the shoe about the axis of the stub shafts 35, and the adjustment of the shoe transversely of the beam 34. Rotational adjustment is effected by means of positioning lugs 37, which are secured to the opposite ends of the beam 34 and extend through windows 38 in the secondary levers. Opposed adjusting bolts 39, 40, carried by the secondary levers, may be manipulated to establish the position of the lugs 37 and thereby the rotational orientation of the beam 34 and shoe 14. Transverse adjustment of the shoe may be controlled by means of positioning bolts 41 (FIG. 1).

In a typical operation, a web of tubular or other fabric 42 is advanced toward the feeding roller 12 and entered between the outer surface of that roller and the bottom surface 36 of the shoe plate 14. The feed roller 12, which has limited frictional gripping characteristics, is kept in light contact with the fabric over a large area, by means of the arcuate surface 36 of the shoe. At the end of the feeding stage, the fabric emerges from underneath the edge of the shoe tip 25 and, after passing through the short compacting zone C, enters and passes through the roller nip 24. While in the nip, the fabric is being acted upon simultaneously by both the feeding and retarding rollers, with the retarding roller moving at a somewhat lower surface speed and having the predominant frictional gripping characteristics with respect to the fabric, such that the fabric is decelerated largely to the speed of the retarding roller. In passing through the roller nip, the fabric is subjected to heat (from the rollers) and considerable localized pressure resulting from the squeezing together of the rolls at the nip. The emerging fabric 42*a* (FIG. 4) is in a compressively shrunk condition, in the lengthwise direction.

In accordance with the present invention, critical adjustments of the length of the compacting zone C are enabled by provision of means for simultaneously effecting precision pivotal adjustment of the primary levers 26 about the axis of the feed roll shaft 17. With reference particularly to FIGS. 3–8, the adjusting mechanism of the invention includes a pair of jack shafts 50, 51 (FIG. 5) which are guided in bushings 52 in the frame brackets 15, for limited movement along vertical axes. The lower ends 53 of the jack shafts extend through worm gear and worm wheel assemblies 54, which are mounted on brackets 55 secured to legs 56 of the machine frame. The worm gear assemblies 54 include worm wheels 57 which threadably engage the lower portions 53 of the jack shafts, such that rotation of the worm wheels 57 will either raise or lower the jack shafts, correspondingly. The worm gears 57*a* of the assemblies 54 are connected to each other, through a common drive shaft 58 and a positive but adjustable coupling 59, and the worm gear assembly on the control side of the machine is in turn connected to a control shaft 60 and hand wheel 61. To advantage, the coupling 59 may be of a construction as typified by a Boston FA-75 toothed coupling. This enables the two worm gear assemblies to be precisely phased in the initial set-up of the machine, by permitting relative rotation of one assembly 54 relative to the other, while assuring positive synchronous movement of the two gear assemblies during normal operation.

Rigidly secured to the upper end portions of the jack shafts, desirably between the areas thereof supported by the bushings 52, are slide blocks 62, forming part of a universal clevis unit 63 at each side. Each clevis unit includes a laterally opening, U-shaped clevis element 64, which is secured to the adjacent slide block by a shouldered bolt 65 and is thereby arranged for limited rotational movement about the horizontal axis of the shouldered bolt. The clevis element 64 is provided with machine surfaces 66 on the inside of its horizontally extended legs, which have a low tolerance, sliding fit with similarly machined upper and lower surfaces of the positioning lugs 28 of the primary levers 26. Accordingly, upon raising and lowering of the jack shafts, the clevis units will move vertically therewith, effecting related vertical movement of the lever positioning lugs 28 which are embraced thereby.

Because the positioning lugs 28 travel in an arcuate path, while the clevis assembly travels in a straight line path, limited radial sliding movement is accommodated between the machined inner surfaces 66 of the clevis and similar outer surfaces of the positioning lug embraced thereby. Likewise, limited pivotal movement of the clevis element 64 is accommodated by the shoulder bolt 65, enabling the clevis element to assume the various angular positions of the positioning lugs 28, as reflected in FIGS. 7 and 8.

Because the positioning of the primary levers 26 is rather critical, the entire force train must be as rigid as practicable in the force transmitting directions. To this end, the clevis element 64 and slide block 62 are shaped and proportioned to have spaced, confronting bearing areas 67 above and below the shouldered bolt 65. These widely spaced bearing areas assure the effective alignment of the clevis element 64 with respect to the horizontal axis of the shoulder bolt 65, to provide rugged support for the primary shoe positioning levers 26.

In order to facilitate retrofit application of the adjustment system, and also to facilitate disengagement of the adjusting mechanism from the primary levers 26 for occasional maintenance, the slide blocks 62 are radiused along their outer edges 68 (FIG. 2) about the axis of the jack shafts 50, 51. The radius corresponds to half the thickness of the slide block 62.

In normal operation, the back surface 69 (FIG. 2) of the slide block slidingly engages a supporting surface 70 of the frame bracket 15. The slide block is normally held against the surface 70 by means of a latch arm 71 pivotally secured to a block 72 bolted to the frame bracket 15. Normally, a simple thumb screw or the like 73 is suitable for locking the latch bar 71 in a horizontally disposed normal operating position. At its outer end, the latch bar 71 carries a pressure bolt 74, which is threaded into the latch bar and has its end portion projecting through to the back side and slideably engaging the block 62, urging it against the bracket surface 70. The slide block being thus locked against rotation by the latch bar 71, serves to prevent rotation of the jack shaft 50, 51 during rotation of the worm gears 57.

Release of the clevis assemblies 63 from the primary levers 26 is accommodated easily, by loosening the thumb screws 73 and allowing the latch bar 71 to swing down to a vertical position. The entire clevis unit, still attached to the jack shaft, may then be pivoted outward, as reflected in FIG. 6, for example.

As will be readily appreciated, precision simultaneous adjustment of both primary shoe supporting levers 26 may be effected by manipulation of the hand wheel 61. This is easily accomplished while the machine is in normal, full speed operation, and the operator may instantly observe the results of the adjustment as the fabric emerges on the downstream side of the roller nip. To advantage, the hand wheel 61 may be of a commercially available type incorporating a built-in position indicator, such that the operator may conveniently pre-set the wheel approximately to its optimum position, based on prior operating experience with a given fabric.

Figure 9:
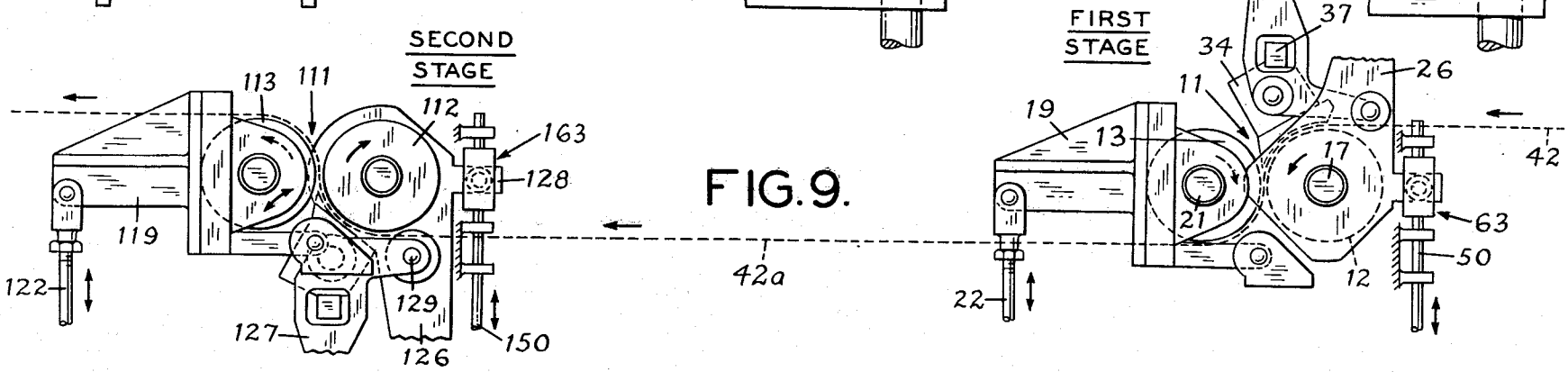
FIG. 9 is a highly simplified, schematic representation of the two stations of a double station compactor, with each station incorporating an adjustment feature according to the invention.
Figure 10:
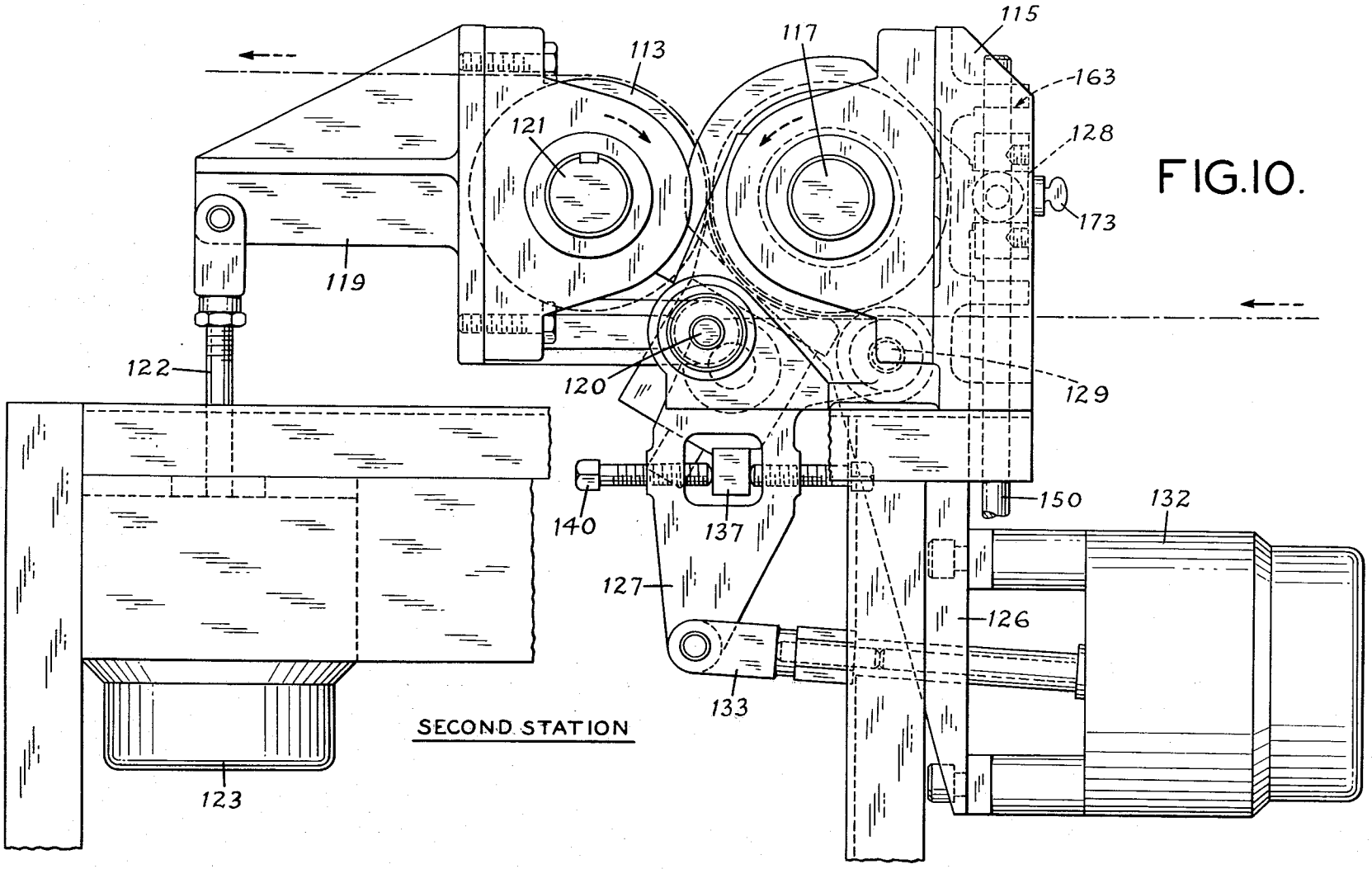
FIG. 10 is a side elevational view illustrating the manner in which the adjustment mechanism of the invention is installed at the second compacting stage of a two stage compactor.

In many if not most installations of compactor equipment of the type herein above described, the equipment incorporates two compacting stations, one reversely oriented relative to the other. This is particularly desirable in the processing of tubular fabrics, for example, in order to achieve optimum balance of the mechanical effects on the opposite surfaces of the fabric tube. The adjustment mechanism of the invention is as readily applied to the second or reverse stage of a two station machine, as to the first stage just described. In FIG. 9, for example, there is a schematic illustration of a machine having a first compacting stage 11 and a reversely oriented stage 111. The respective feeding and retarding rolls 112, 113 are rotating in opposite directions, relative to the first station, and the once processed fabric 42*a* approaches the second station from underneath. The compacting shoe, and its related positioning mechanism, is mounted in upside down relation, as compared to the first station, but is otherwise functionally similar. Thus, in FIG. 10 is shown a jack shaft 150 guided for vertical movement in a machine bracket 115 and carrying a universal clevis unit 163 corresponding to the unit 63 heretofore described. Other corresponding parts of the second stage apparatus bear reference numerals corresponding to those of the first stage, being preceded, however, by the number 1.

In arrangement of FIG. 10, the primary shoe positioning lever 126 extends generally downward and mounts an air actuator 132. The rod 133 of this actuator is connected to the secondary shoe positioning lever 127, also extending generally downward from its pivot pin 129. As in the case of the first stage, the primary lever is provided with a positioning lug 128, extending radially with respect to the feed roll shaft 117 and having opposed parallel surfaces closely embraced by the universal clevis unit 163.

Figure 5:
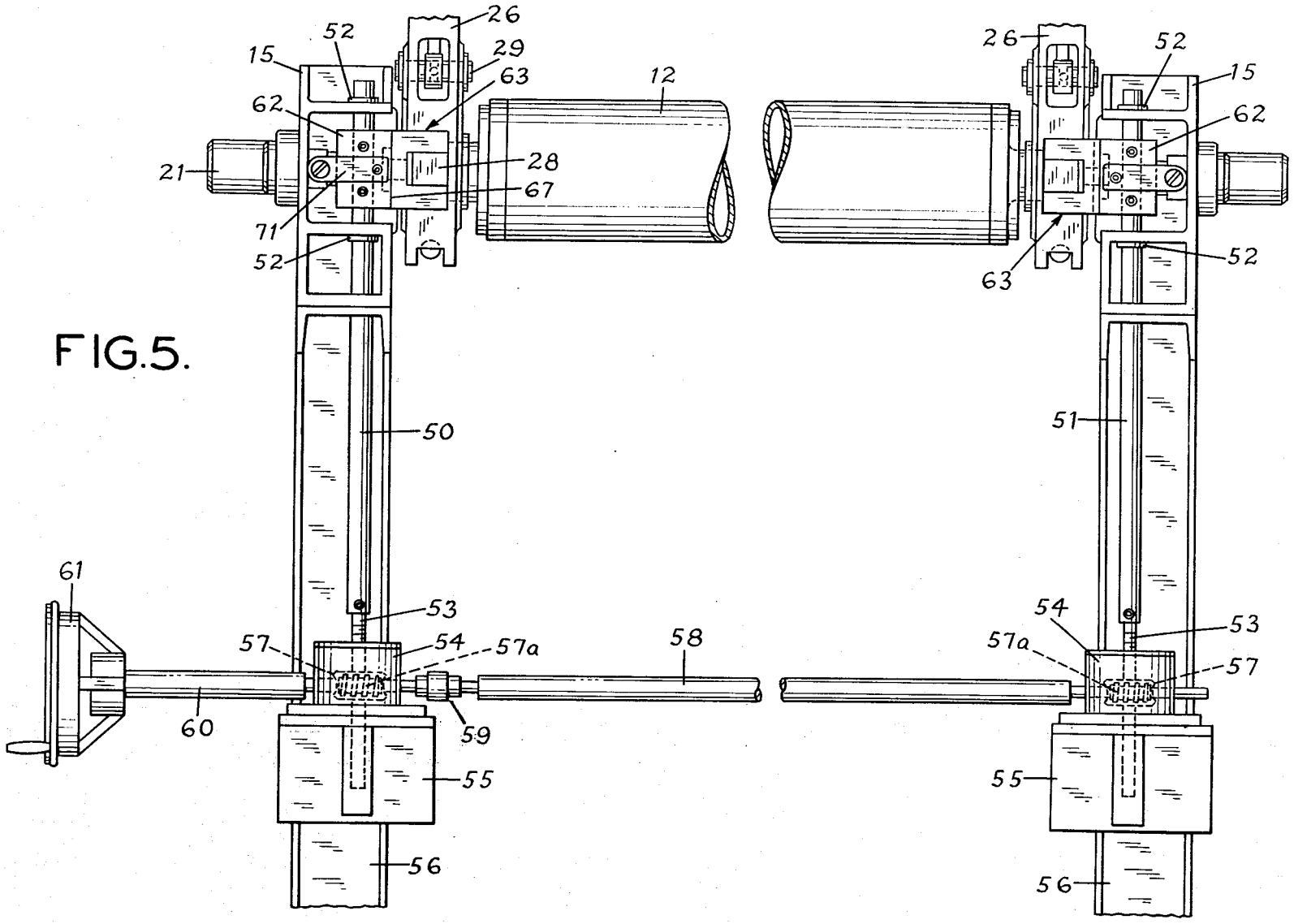
FIG. 5 is a front elevational view, illustrating primarily the elements of the adjusting mechanism as positioned for retrofit on an existing standard compactor machine.
Figure 7:
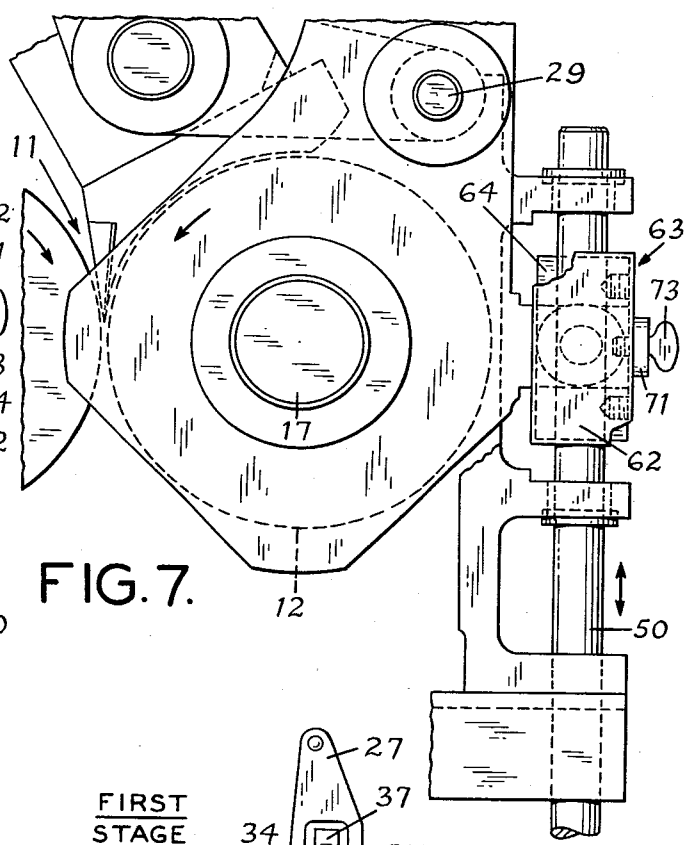
FIGS. 7 and 8 are fragmentary side-elevational views illustrating a sequence of movement of the adjusting mechanism, in controlling the position of the compactor shoe tip.
Figure 8:
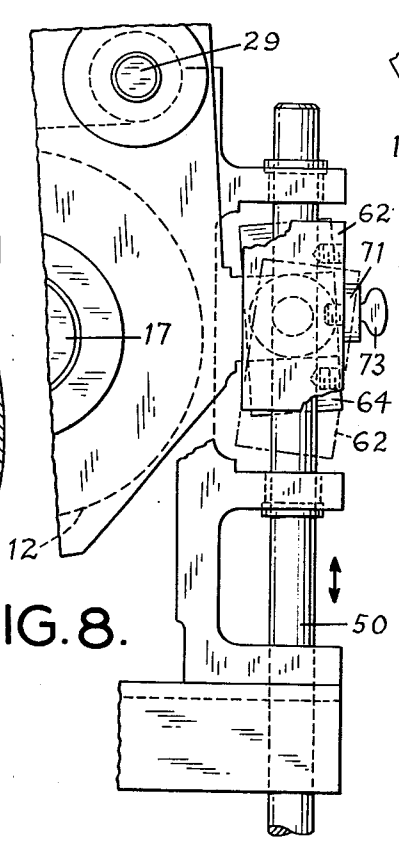
Figure 6:
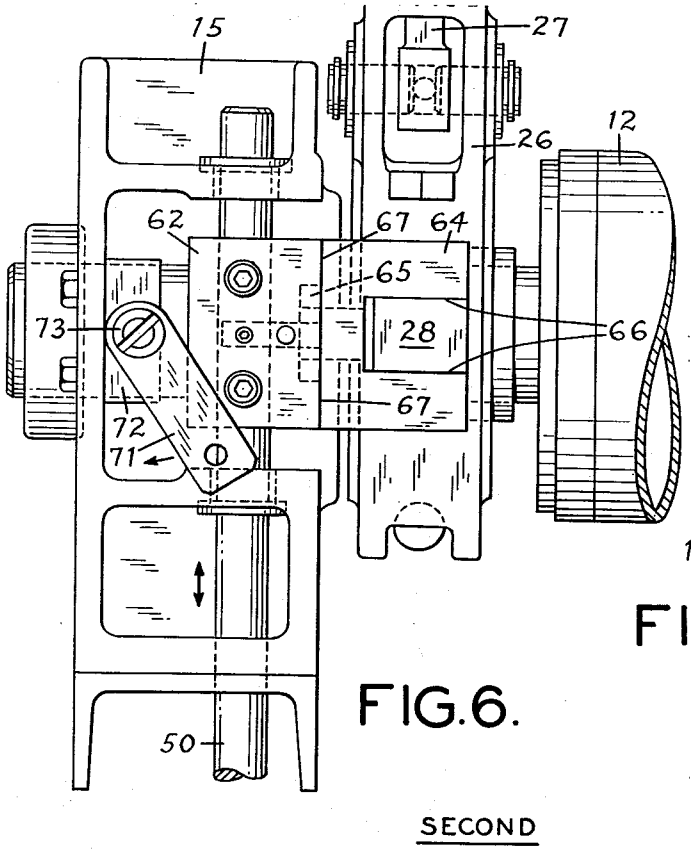
FIG. 6 is an enlarged, fragmentary view, similar to FIG. 3, illustrating the manner in which the adjusting mechanism may be engaged and disengaged from the compactor shoe assembly.

The basic adjustment assembly for the second stage unit is, in general, exactly the same as shown in FIG. 5. In this respect, the adjustment assembly is essentially uneffected by the fact that the second stage is reversely oriented with respect to the first. In either case, precise, on-line shoe adjustment is made possible by synchronous vertical adjustments of the jack shafts, under the control of a single hand wheel accessible to the operator at the control side of the machine.

One of the important practical advantages of the invention resides in the fact that what has heretofore been a time consuming and delicate adjustment operation, difficult or impossible to accomplish while the equipment is in operation, is now made into a simple, one-hand adjustment by the operator, from the control side of the machine, while he visually monitors the production of the machine to observe exactly the process effect of the shoe tip adjustment. Because proper shoe tip adjustment can be so critical to the operation, this feature enables the production of a compactor line to be maintained on an optimized basis at all times.

Also of significance, the specific mechanical make-up of the adjustment mechanism is such as to enable it to be easily and inexpensively installed in existing equipment, as a field retrofit operation, so that the performance of the equipment already in the field can be upgraded. This is an important practical consideration, bearing in mind that large numbers of such machines, which are both complex and expensive, are already in use, and significant economic benefits may be achieved through a retrofit program, as compared to replacement of the basic equipment.

One of the more specific features of practical significance is the provision of a positive drive adjustable coupling between the gear assemblies at each side of the machine to facilitate, in the initial machine set up, precise alignment of the shoe plate at opposite sides. This arrangement also enables occasional re-alignment of the shoe, as needed, while at the same time assuring precise synchronism of the primary lever movement at both sides of the machine in effecting normal process adjustments.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a two-roll compactor apparatus for compressively shrinking web materials and of the type comprising a machine frame, opposed feeding and retarding rollers mounted in said frame and forming a compacting nip, a compacting shoe cooperating with said rollers and said nip and having a blade-like tip spaced slightly from said nip and forming therewith a compacting zone, and means for adjusting the position of the shoe tip about the axis of said feeding roll, the improvement which comprises a. a pair of primary shoe mounting levers positioned one at each end of the feed roller and supported for limited rotational movement about the axis of the feed roller, b. said compacting shoe extending between and being mounted at its ends by said primary shoe mounting levers, c. said primary levers being normally independently movable about said axis, d. each of said primary levers having a positioning lug extending therefrom, e. a pair of jack shafts mounted in said frame one at each side, and guided for limited movement along linear axes extending generally tangentially with respect to the positioning lugs of the respective primary levers, f. connecting means carried by each of said jack shafts and engaging the respective positioning lugs, whereby movement of said jack shafts along their respective linear axes effects controlled rotational movement of said primary levers, g. a pair of threaded worm wheels rotatably supported by said machine frame and threadably engaging said jack shafts for effecting controlled axial movement thereof, h. drive shaft means connecting said worm wheels for effecting simultaneous rotation thereof.

i. said drive shaft means including an adjustable, normally fixed coupling means for controlling the rotational orientation of one of said worm wheels relative to the other.

2. A compactor improvement according to claim 1, further characterized by a. said positioning lugs extending radially of the axis of said feeding roller, b. said connecting means comprising a pair of universal clevis units, c. each clevis unit comprising a slide member secured rigidly to a jack shaft, and a U-shaped clevis element pivotally secured to said slide member, d. said clevis element closely and slideably embracing said positioning lugs whereby, upon movement of said jack shafts along their linear axes, said clevis elements are adapted to rotate relative to said slide elements and to slide relative to said positioning lugs.

3. The compactor improvement of claim 2, further characterized by a. guide surfaces being provided on the machine frame positioned normally to slideably engage surfaces of said slide members, b. said slide elements being rotatable with said jack shafts through a limited angle in a direction away from said machine surfaces, and c. latch bar means for holding said slide elements against such rotation.

4. The compactor improvement of claim 1, further characterized by a. said adjustable coupling means comprising an adjustable toothed coupling connecting respective portions of said drive shaft means, whereby said respective drive shaft portions are normally locked in predetermined rotational orientation during adjustment of said jack shafts.

5. The compactor improvement of claim 4, further characterized by a. said drive shaft means including a section accessible at the operator side of the machine and mounting an indicating hand wheel.

6. In a two-roll compactor apparatus for compressively shrinking web materials and of the type comprising a machine frame, opposed feeding and retarding rollers mounted in said frame and forming a compacting nip, a compacting shoe cooperating with said rollers and said nip and having a blade-like tip spaced slightly from said nip and forming therewith a compacting zone, and means for adjusting the position of the shoe tip about the axis of said feeding roll, the improvement which comprises a. a pair of primary shoe mounting levers positioned one at each end of the compactor shoe and supported for limited pivotal movement about a predetermined axis, b. said primary levers being normally independently moveable about said axis, c. each of said primary levers having a positioning lug extending generally radially of said axis and having opposed flat smooth surfaces, d. a pair of jack shafts mounted in said frame and restrained against rotation therein while being guided for limited linear movement along their respective axes, e. said axes being disposed generally at right angles to the axis of said primary levers, f. universal clevis means carried by said jack shafts and engaging said positioning lugs for translating axial movement of said jack shafts into pivotal movement of said levers, g. threaded drive means operable from one side of the machine and engaging both of said jack shafts for translating said jack shafts along their respective axes equally and simultaneously, to effect adjustment of said shoe tip.

7. The compactor improvement of claim 6, further characterized by a. said drive means including normally positively engaged adjustable coupling means connected between said jack shafts, for accommodating occasional relative movement of one shaft with respect to the other, independent of normal adjusting movements thereof.

8. The compactor improvement of claim 7, further characterized by a. said jack shafts extending generally vertically along frame members of said machine, at opposite sides, b. threaded worm gear assemblies mounted in said frame, below said rollers, and engaging the respective jack shafts at their lower ends, and c. said drive means including a drive shaft interconnecting said worm gear assemblies, enabling said assemblies to be adjustably manipulated equally and simultaneously.

9. The compactor improvement of claim 6, further characterized by a. said universal clevis assemblies comprising slide blocks fixed to said jack shafts, b. said clevis assemblies further including U-shaped clevis elements pivotally secured to said slide blocks, for rotation about axes normally parallel to the pivot axis of said primary levers, c. said slide blocks and clevis elements having confronting surfaces on opposite sides of the axes of rotation of said clevis elements for relatively rigid support of said elements.

* * * * *